US007105782B2

(12) United States Patent
Yue

(10) Patent No.: US 7,105,782 B2
(45) Date of Patent: Sep. 12, 2006

(54) ELECTROTHERMAL ARTICLE

(76) Inventor: Steven Yue, 4F, No. 7, Lane 180, Section 2, Yen-Chiu-Yuan Road, Nan-Kang District, Taipei City (TW)

( * ) Notice: Subject to any disclaimer, the term of this patent is extended or adjusted under 35 U.S.C. 154(b) by 0 days.

(21) Appl. No.: 10/989,757

(22) Filed: Nov. 15, 2004

(65) Prior Publication Data

US 2006/0102616 A1 May 18, 2006

(51) Int. Cl.
*H05B 3/54* (2006.01)

(52) U.S. Cl. ..... 219/528; 219/529; 219/536; 219/538; 219/211

(58) Field of Classification Search ..... 219/528–29, 219/536–539, 541, 544–45, 211–12, 217
See application file for complete search history.

(56) References Cited

U.S. PATENT DOCUMENTS 6,403,935 B1 * 6/2002 Kochman et al. ..... 219/545
6,548,789 B1 * 4/2003 Rock et al. ..... 219/545
6,770,854 B1 * 8/2004 Keane ..... 219/529

* cited by examiner

*Primary Examiner*—Shawntina T. Fuqua
(74) *Attorney, Agent, or Firm*—Merchant & Gould P.C.

(57) ABSTRACT

An electrothermal article including a fabric member defining an inner space. A connector is disposed outwardly of the inner space in the fabric member and has conductive first and second terminals. A plurality of elongated flat heating elements is disposed in the inner space in the fabric member. Each of the elongated flat heating elements has first and second end portions. The first end portions of the elongated flat heating elements are grouped into a first bundle and are connected electrically to the first terminal of the connector. The second end portions of the elongated flat heating elements are grouped into a second bundle and are connected electrically to the second terminal of the connector.

7 Claims, 4 Drawing Sheets

ELECTROTHERMAL ARTICLE

BACKGROUND OF THE INVENTION

1. Field of the Invention

This invention relates to an electrothermal article, such as an electric blanket, a mattress pad, a heating pad, and the like, more particularly to an electrothermal article including a plurality of elongated flat heating elements that have two grouped end portions.

2. Description of the Related Art

Electrothermal articles commonly used in our daily life include electric blankets and mattress pads. As shown in FIG. 1, a conventional heating blanket 101 includes an upper fabric sheet 10, a lower fabric sheet 11, an inner space 100 defined between the upper and lower fabric sheets 10, 11, and a heating wire 12, which is generally made from a nickel-chromium material, and which is meanderingly disposed in the inner space 100. The upper and lower fabric sheets 10, 11 are stitched together. The heating blanket 101 has a corner 13 provided with a connector 2 that is disposed outwardly of the inner space 100. The connector 2 has two terminals 20, 21. Each of the terminals 20, 21 has a power supply-connecting end 200, 210 and a heating wire-connecting end 201, 211. The power supply-connecting ends 200, 210 of the connector 2 protrude outwardly of the heating blanket 101. The heating wire-connecting ends 201, 211 of the connector 2 are connected to two ends 120, 121 of the heating wire 12, respectively, so as to form a loop. When the power supply-connecting ends 200, 210 of the connector 2 are electrically connected to a power supply, the heating wire 12 will generate heat caused by a current flowing therethrough. However, the user will feel uncomfortable when sitting on the heating blanket 101 due to the thickness and hardness of the heating wire 12. In addition, the heating wire 12 of the conventional heating blanket 101 may break when bent inappropriately or during a washing operation.

SUMMARY OF THE INVENTION

Therefore, the object of the present invention is to provide an electrothermal article that eliminates the aforesaid drawbacks of the prior art.

According to this invention, there is provided an electrothermal article including a fabric member that defines an inner space therein, a connector disposed outwardly of the inner space in the fabric member and including conductive first and second terminals, and a plurality of elongated flat heating elements disposed in the inner space in the fabric member. Each of the heating elements has first and second end portions. The first end portions of the heating elements are grouped into a first bundle and are connected electrically to the first terminal of the connector. The second end portions of the heating elements are grouped into a second bundle and are connected electrically to the second terminal of the connector.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENTS

Figure 1:
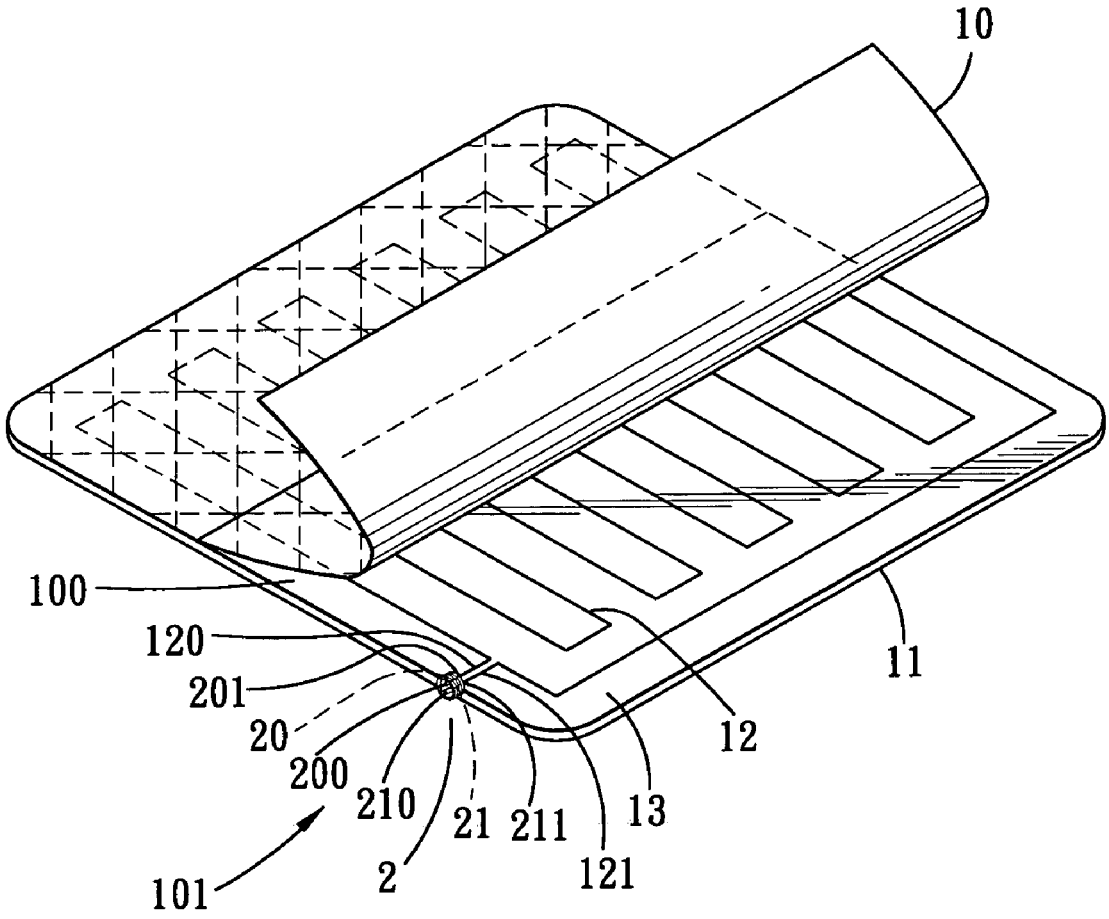
FIG. 1 PRIOR ART
FIG. 1 is a perspective view to illustrate a conventional heating blanket with an upper sheet lifted to show a heating wire disposed therein.
Figure 2:
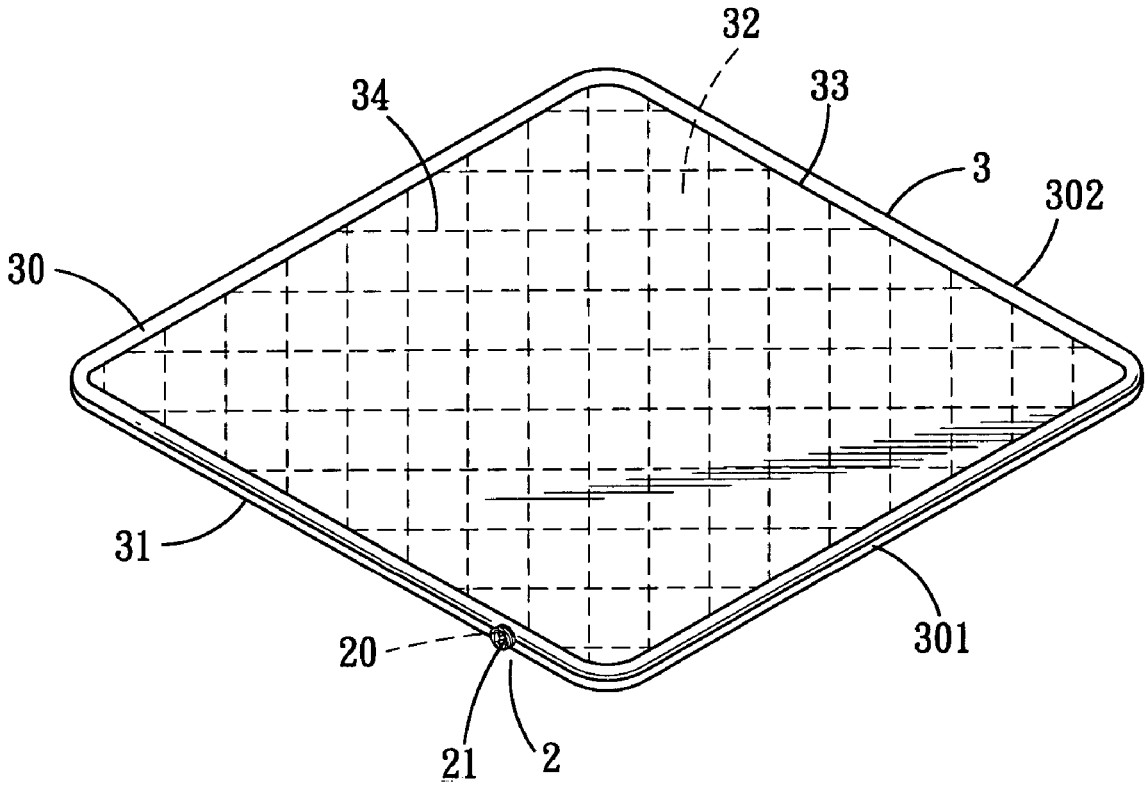
FIG. 2 is a perspective view of the preferred embodiment of an electrothermal article according to this invention.
Figure 4:
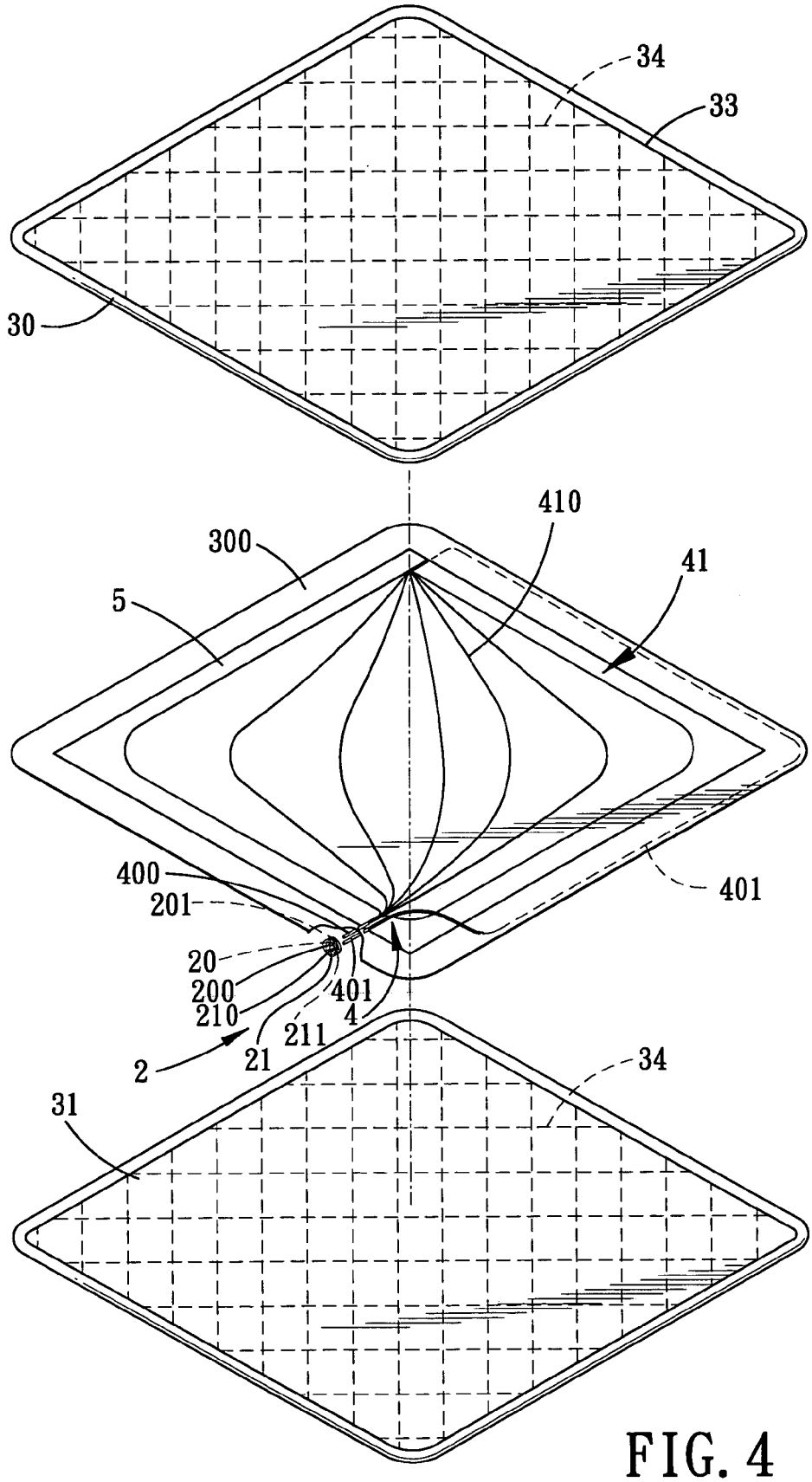
FIG. 4 is an exploded perspective view of the preferred embodiment.

Referring to FIGS. 2 and 4, the preferred embodiment of an electrothermal article according to this invention is shown to include: a fabric member 3 that has an upper fabric sheet 30 and a lower fabric sheet 31 and that defines an inner space 32 between the upper fabric sheet 30 and the lower fabric sheet 31; a connector 2 disposed outwardly of the inner space 32 in the fabric member 3 and including conductive first and second terminals 20, 21; and a plurality of elongated flat heating elements 41 disposed in the inner space 32 in the fabric member 3. Preferably, the fabric member 3 further includes a middle fabric sheet 300 sandwiched between the upper and lower fabric sheets 30, 31.

Figure 3:
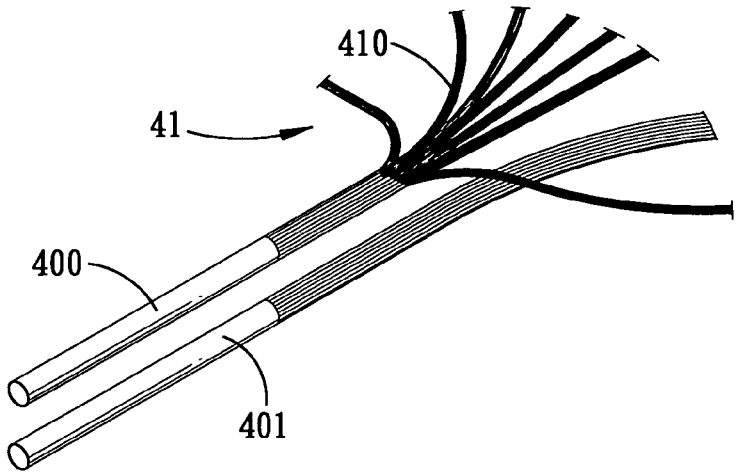
FIG. 3 is a fragmentary perspective view to illustrate a plurality of heating elements used in the preferred embodiment.
Figure 5:
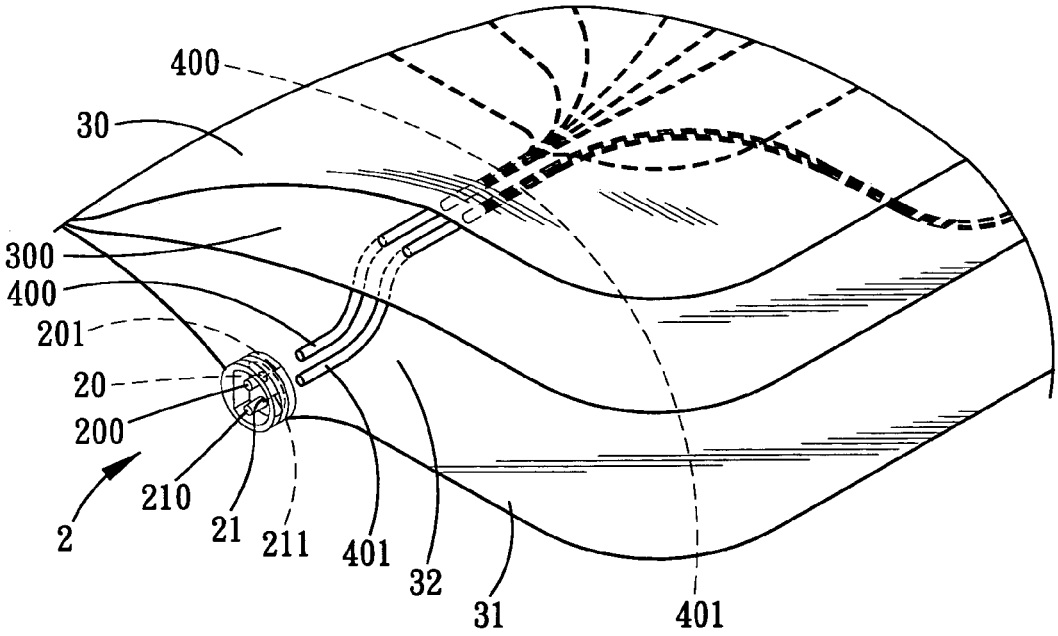
FIG. 5 is a fragmentary perspective view illustrating how the heating elements are connected to a connector in the preferred embodiment.

Referring to FIG. 3 in combination with FIGS. 4 and 5, each of the elongated flat heating elements 41 has first and second end portions 400, 401. The first end portions 400 of the elongated flat heating elements 41 are grouped into a first bundle. The second end portions 401 of the elongated flat heating elements 41 are grouped into a second bundle. Each of the conductive first and second terminals 20, 21 has a power input-connecting end 200, 210 adapted to be connected to a power supply, and a heating element-connecting end 201, 211. The first and second bundles of the first and second end portions 400, 401 of the elongated flat heating elements 41 are connected electrically and detachably to the heating element-connecting ends 201, 211 of the first and second terminals 20, 21 of the connector 2, respectively, so as to form a loop. Preferably, each of the elongated flat heating elements 41 is made from a flexible electrothermic material, and is sheathed by a resistive material. More preferably, each of the elongated flat heating elements 41 includes a plurality of filaments of carbon fiber.

In addition, the fabric member 3 further defines a heating area between the upper and middle fabric sheets 30, 300. Each of the elongated flat heating elements 41 further has an intermediate portion 410 that extends between the first and second end portions 400, 401. The intermediate portions 410 of the elongated flat heating elements 41 are distributed across the heating area, and are sandwiched between the upper and middle fabric sheets 30, 300. The connector 2 is adapted to be electrically connected to a power supply (not shown) for activating the elongated flat heating elements 41 to generate heat, which spreads evenly through the heating area.

Preferably, the fabric member 3 is rectangular in shape, and has a first corner and a second corner which are disposed diagonally opposite to each other, a first side 301 that extends from the first corner, and a second side 302 that is transverse to and that extends from the first side 301 to the second corner 302. The first bundle is disposed adjacent to the first corner and the second bundle extends from the first corner to the second corner along the first and second sides 301, 302.

In this embodiment, an adhesive layer 5 is disposed between the upper and middle fabric sheets 30, 300 for bonding the intermediate portions 410 of the elongated flat heating elements 41 to the upper and middle fabric sheets 30, 300. The adhesive layer 5 is made from an adhesive material having a melting point lower than that of the upper, middle, and lower fabric sheets 30, 300, 31. Preferably, the adhesive material is selected from the group consisting of polyamide and polyethylene.

The lower fabric sheet 31, the upper fabric sheet 30 bonded with the intermediate portions 410 of the elongated flat heating elements 41, and the middle fabric sheet 300 are stitched together through interlaced stitching threads 34. The heating area is confined by a peripheral stitching thread 33.

In this embodiment, since each of the elongated flat heating elements 41 are formed from the carbon fiber filaments, the elongated flat heating elements 41 in the heating area can be conveniently arranged in such a manner that they will not be pierced during a stitching operation by a needle of a sewing machine. Even if a small portion of the filaments of the elongated flat heating elements 41 is damaged by the needle of the sewing machine, operation of the electrothermal article will not be affected.

Furthermore, since the first and second end portions 400, 401 of the elongated flat heating elements 41 which are grouped into the first and second bundles are disposed outwardly of the heating area and the intermediate portions 410 of the elongated flat heating elements 41 are evenly distributed across the heating area, the electrothermal article of this invention is softer and more flexible compared with the conventional electrothermal article.

In addition, as the elongated flat heating elements 41 of the electrothermal article according to this invention are made from carbon fiber, they will not easily break upon bending or during washing operation.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. An electrothermal article, comprising a fabric member that defines an inner space therein;

a connector disposed outwardly of said inner space in said fabric member and including conductive first and second terminals; and a plurality of elongated flat heating elements disposed in said inner space in said fabric member, each of said elongated flat heating elements having first and second end portions, said first end portions of said elongated flat heating elements being grouped into a first bundle and being connected electrically to said first terminal of said connector, said second end portions of said elongated flat heating elements being grouped into a second bundle and being connected electrically to said second terminal of said connector, wherein said fabric member further defines a heating area, each of said elongated flat heating elements further having an intermediate portion extending between said first and second end portions, said intermediate portions of said elongated flat heating elements being distributed evenly across said heating area in different routes.

2. The electrothermal article as claimed in claim 1, wherein each of said elongated flat heating elements includes a plurality of filaments of carbon fiber.

3. The electrothermal article as claimed in claim 1, wherein said fabric member is rectangular in shape, and has a first corner and a second corner which are disposed diagonally opposite to each other, a first side that extends from said first corner, and a second side that is transverse to and that extends from said first side to said second corner, said first bundle being disposed adjacent to said first corner, said second bundle extending from said first corner to said second corner along said first and second sides.

4. The electrothermal article as claimed in claim 1, wherein said fabric member includes an upper fabric sheet, a lower fabric sheet, and a middle fabric sheet sandwiched between said upper and lower fabric sheets, said intermediate portions of said elongated flat heating elements being sandwiched between said upper and middle fabric sheets.

5. The electrothermal article as claimed in claim 4, further comprising an adhesive layer disposed between said upper and middle fabric sheets for bonding said intermediate portions of said elongated flat heating elements to said upper and middle fabric sheets.

6. The electrothermal article as claimed in claim 5, wherein said adhesive layer is made from an adhesive material selected from the group consisting of polyamide and polyethylene.

7. The electrothermal article as claimed in claim 5, wherein said upper fabric sheet bonded with said intermediate portions of said elongated flat heating elements and said middle fabric sheet are stitched together through interlaced stitching threads.

* * * * *